US006928169B1

(12) United States Patent
Aylward

(10) Patent No.: US 6,928,169 B1
(45) Date of Patent: Aug. 9, 2005

(54) AUDIO SIGNAL PROCESSING

(75) Inventor: J. Richard Aylward, Ashland, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 09/220,821

(22) Filed: Dec. 24, 1998

(51) Int. Cl.[7] ..... H04R 5/00
(52) U.S. Cl. ..... 381/17; 381/18
(58) Field of Search ..... 381/17, 18, 1, 381/19, 20, 21, 22, 23, 27, 310, 98; 704/270, 275

(56) References Cited

U.S. PATENT DOCUMENTS 4,521,742 A * 6/1985 Edvardsen ..... 330/289
5,197,100 A * 3/1993 Shiraki ..... 381/27

FOREIGN PATENT DOCUMENTS

| | | |
|---|---|---|
| EP | 014 2213 | 5/1985 |
| EP | 051 7233 | 12/1992 |
| WO | WO912 0165 | 12/1991 |

* cited by examiner

*Primary Examiner*—Ping Lee
(74) *Attorney, Agent, or Firm*—Fish & Richardson P.C.

(57) ABSTRACT

Processing a single channel audio signal provides a plurality of audio channel signals by separating the single channel audio signal into a first separated signal, characterized by a spectral pattern generally characteristic of speech, and a second separated signal processed to provide the remainder of the plurality of audio output channel signals.

23 Claims, 8 Drawing Sheets

AUDIO SIGNAL PROCESSING

Figure 1:
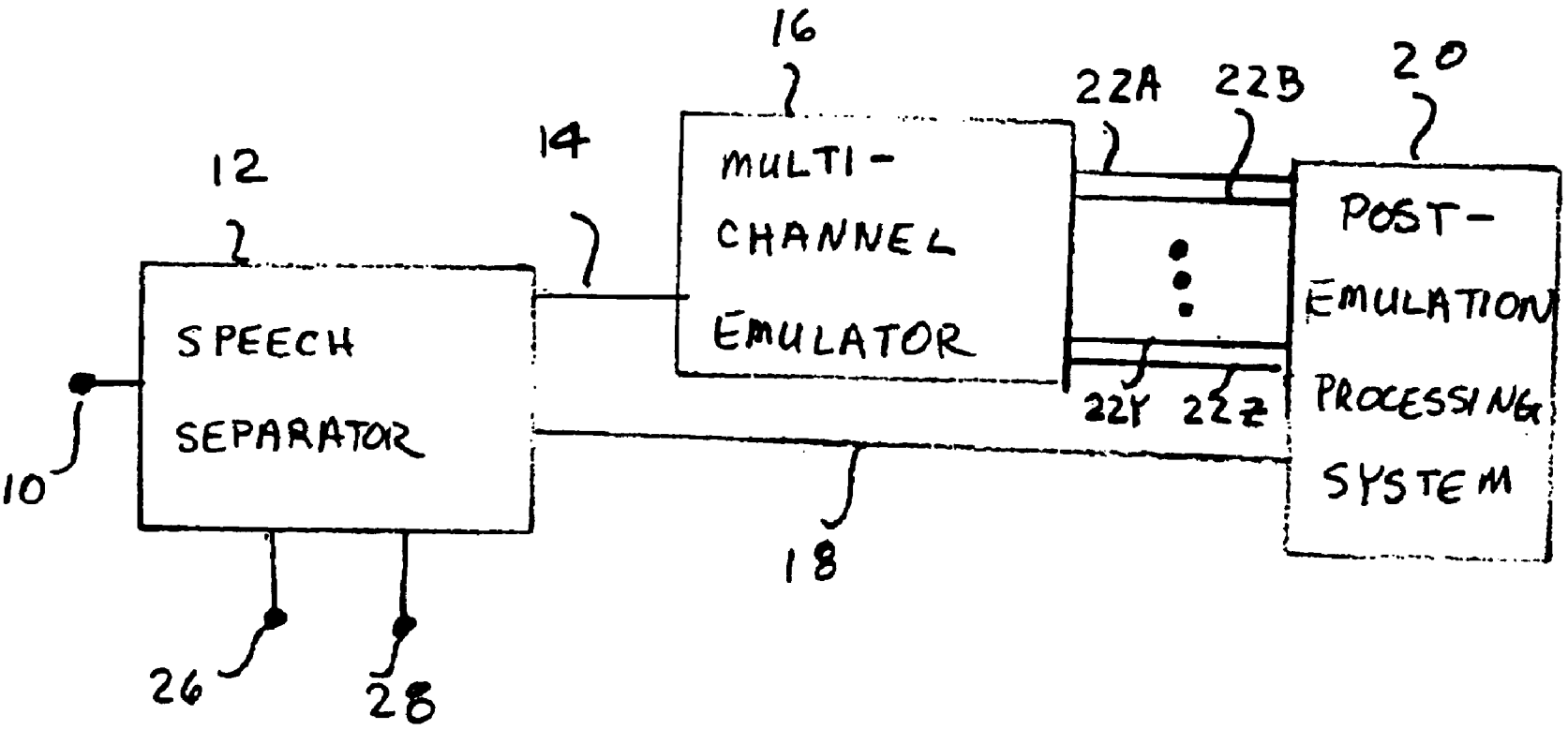

The invention relates to processing audio signals, and more particularly to processing one or more audio input signals to provide more audio signals.

It is an important object of the invention to provide an audio signal processing system to provide a plurality of audio channel output signals from one or more input signals.

According to the invention, a method for processing a single channel audio signal to provide a plurality of audio channel signals includes separating the single channel audio signal into a first separated signal characterized by a frequency spectrum generally characteristic of speech, and a second separated signal; generating a first channel signal from the first separated signal; and modifying the second separated signal to produce the remainder of the plurality of channel signals.

In another aspect of the invention, an audio signal processing apparatus for processing a single channel audio signal to provide a plurality of audio channel signals, includes a speech separator for separating the audio signal into a first separated signal characterized by a frequency spectrum generally characteristic of speech, and a second separated signal; and a circuit coupled to the speech separator for generating a first subset of the plurality of audio channel signals from the second separated signal.

In another aspect of the invention, an audio signal processing system includes an input terminal for a single input channel signal; a center channel output terminal for a center channel output signal C; a plurality of output terminals for a corresponding plurality of output channel signals; a speech separator inter-coupling the input terminal and the center channel output terminal for separating the single channel input signal into a speech audio signal and a nonspeech audio signal; and a circuit coupling the speech separator to the plurality of output terminals for providing, responsive to the nonspeech audio signal, a corresponding plurality of audio channel signals on the output terminals.

In another aspect of the invention, a method for processing a single channel audio signal to provide two decodable audio channel signals decodable into five audio channel signals includes separating the single channel audio signal into a first separated signal characterized by a frequency spectrum generally characteristic of speech, and a second separated signal; processing the first separated signal to provide a center channel signal C; modifying the second separated signal to provide a left channel signal L, a right channel signal R, a left surround channel signal $L_S$, and a right surround channel signal $R_S$; combining the center channel signal, a sum of the left surround and the right surround channel signals and the left channel signal to produce a first of the two decodable audio channel signals; and combining the center channel signal, a sum of the left surround and the right surround channel signals and the right channel signal to produce a second of the two decodable audio channel signals.

In another aspect of the invention, a method for processing a single channel audio signal to provide three decodable audio channel signals subsequently decodable into five audio channel signals, comprises separating the single channel audio signal into a first separated signal characterized by a frequency spectrum generally characteristic of speech, and a second separated signal; processing the first separated signal to provide a center channel signal, the center channel signal comprising the first decodable audio signal; modifying the second separated signal to provide a left channel signal, a right channel signal, a left surround channel signal, and a right surround channel signal; combining a sum of the left surround and the right surround channel signals and the left channel signal to produce a second of the three decodable audio channel signals; and combining a sum of the left surround and the right surround channel signals and the right channel signal to produce a third of the three decodable audio channel signals.

In another aspect of the invention, a method for processing two input audio channel signals to provide more than two output audio channel signals includes separating each of the two input audio channel signals into a first separated signal characterized by a frequency spectrum generally characteristic of speech, and a second separated signal; combining the first separated signal of the first input audio channel signal and the first separated signal of the second input audio channel signal to form a first of the more than two output audio channel signals; transmitting the second separated signal of the first input signal as a second of the more than two output audio channel signals; and transmitting the second separated signal of the second input signal as a third of the more than two output channel signals.

In still another aspect of the invention, an audio signal processing apparatus for processing two input audio channel signals to provide more than two output audio channel signals includes a first speech separator for separating a first of the two input audio channel signals into a first separated signal characterized by a frequency spectrum characteristic of speech to provide a first of the more than two output audio channel signals; a second speech separator for separating a second of the two audio channel signals into a first separated signal characterized by a frequency spectrum characteristic of speech, and a second of the more than two output audio channel signals; and a combiner for combining the first and second separated signals to form a third of the more than two output audio channel signals.

Figure 2A:
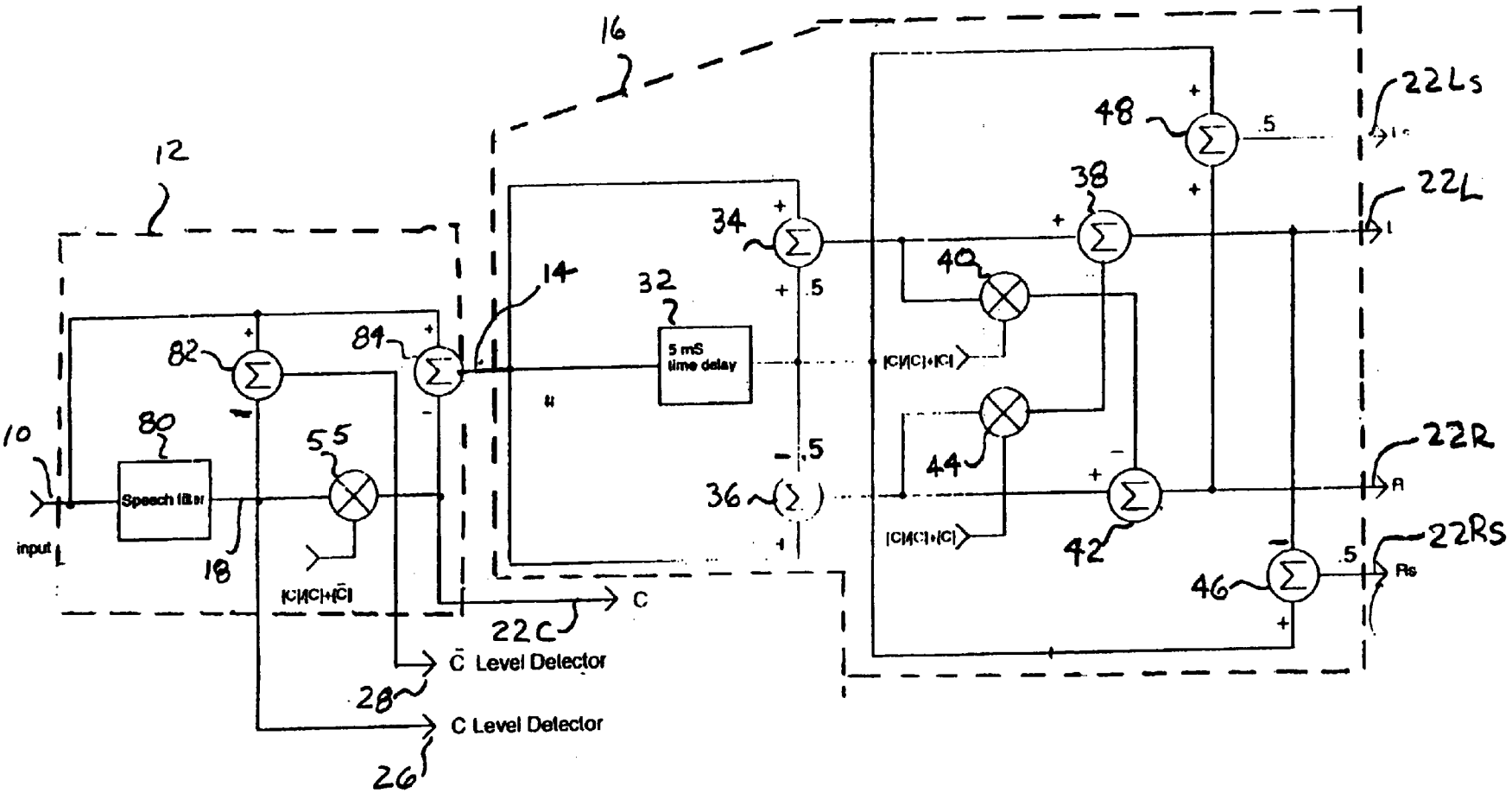
Figure 2B:
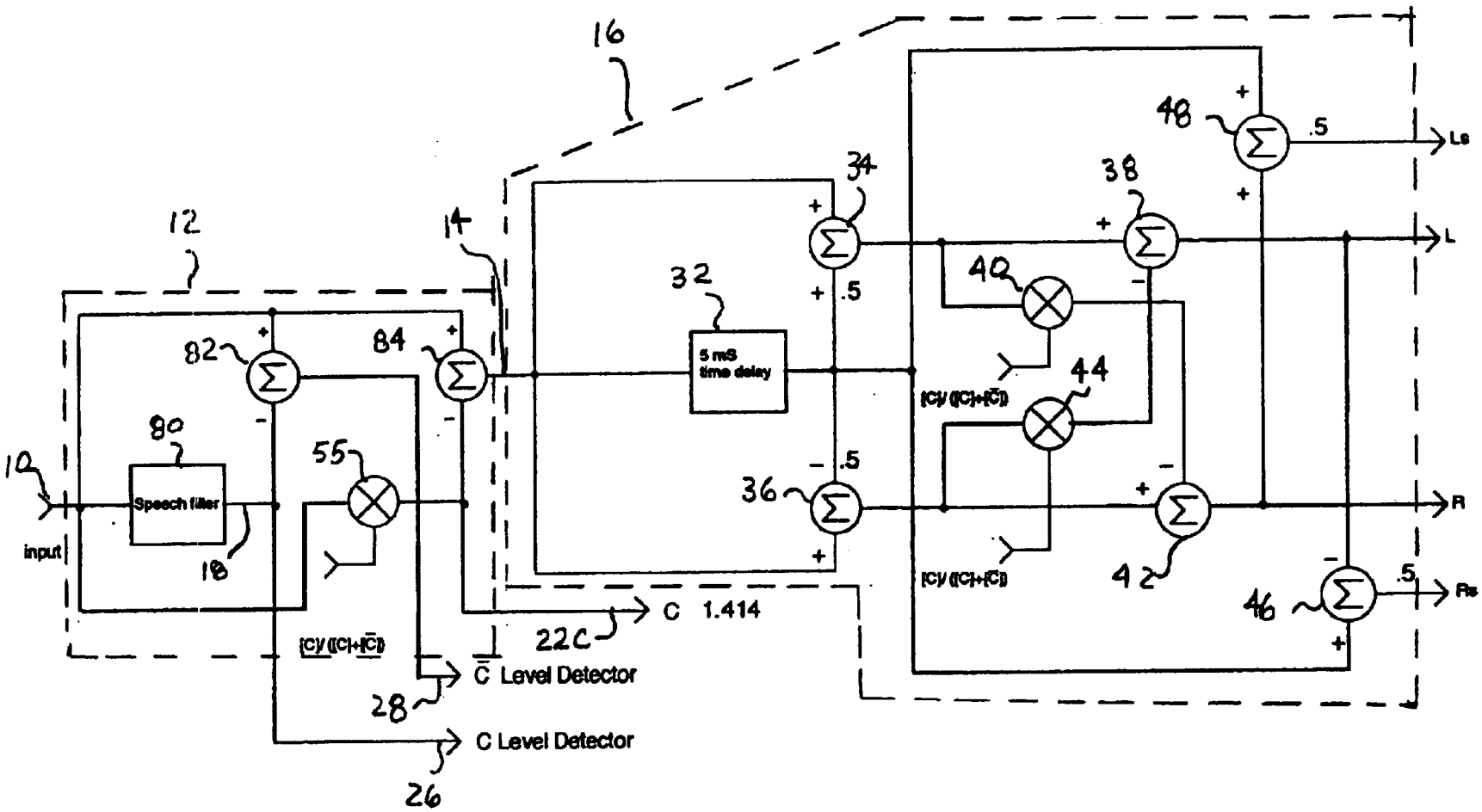
Figure 3A:
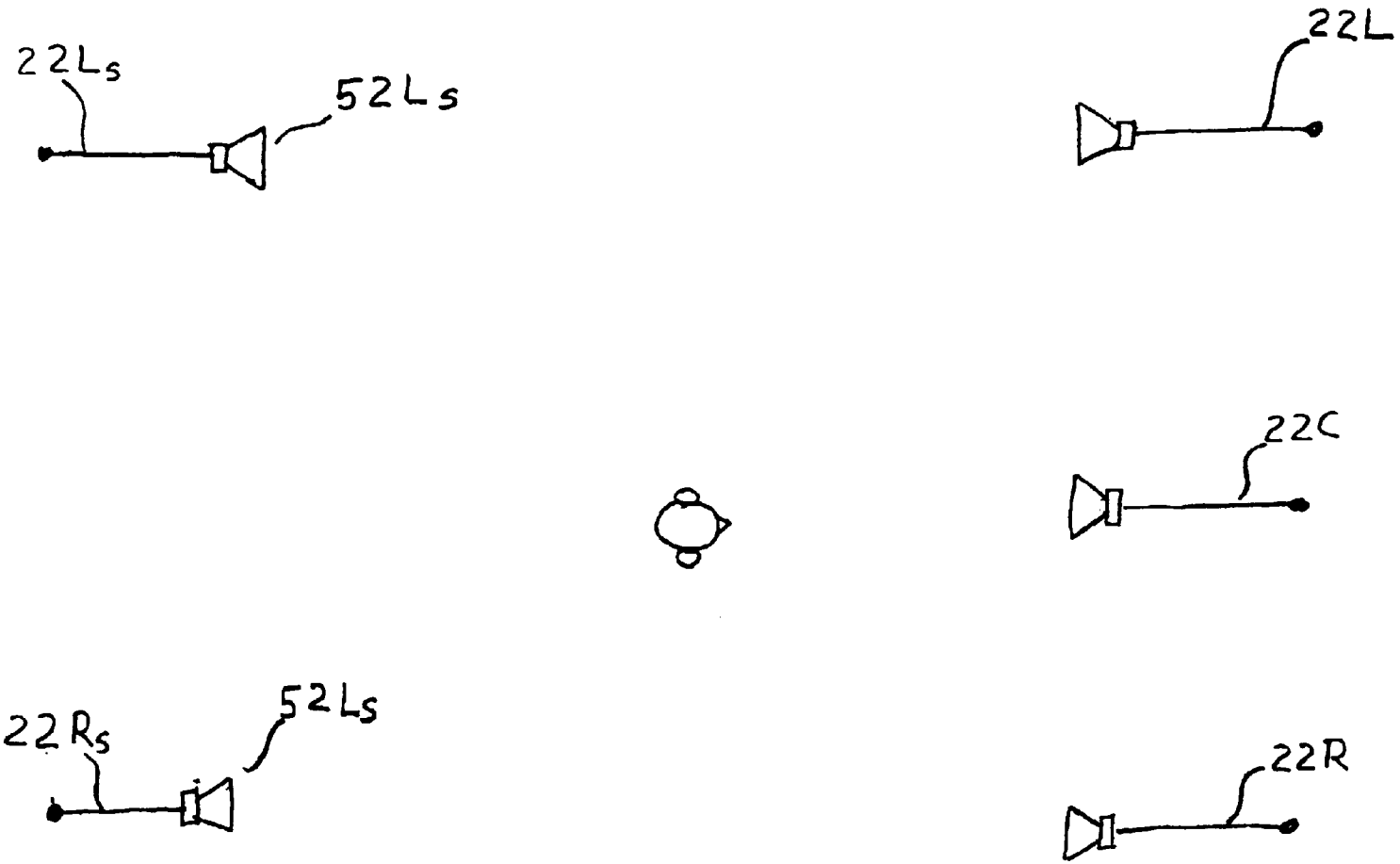
Figure 3B:
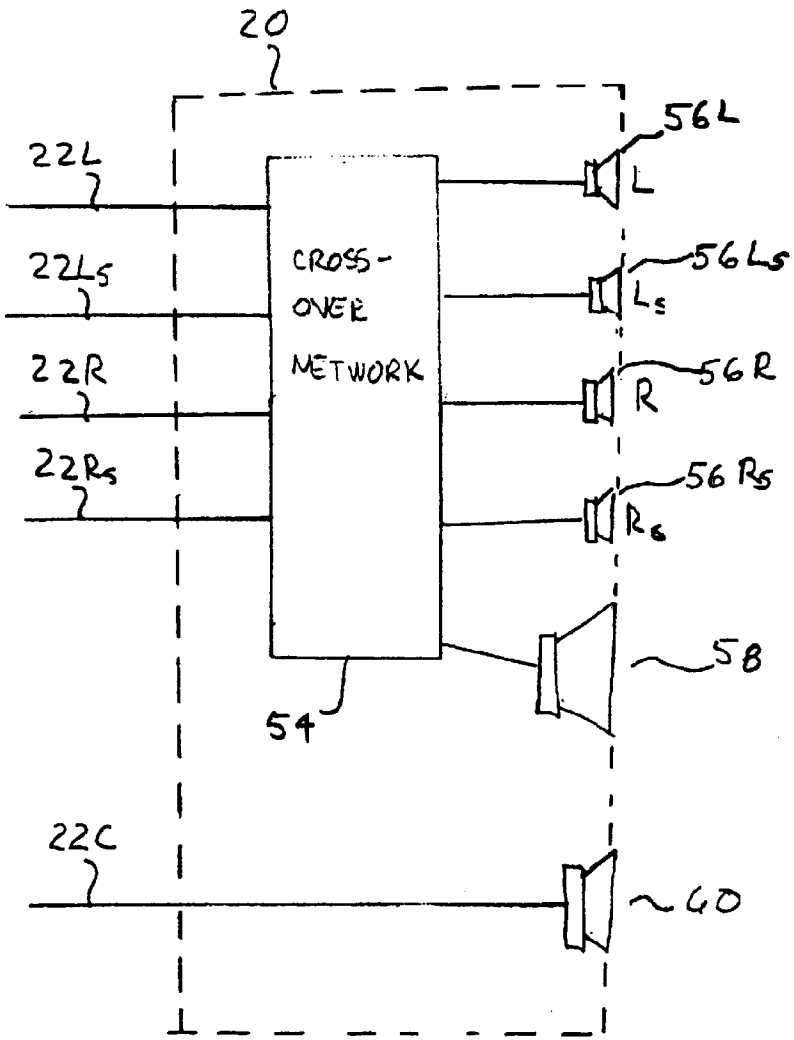
Figure 3C:
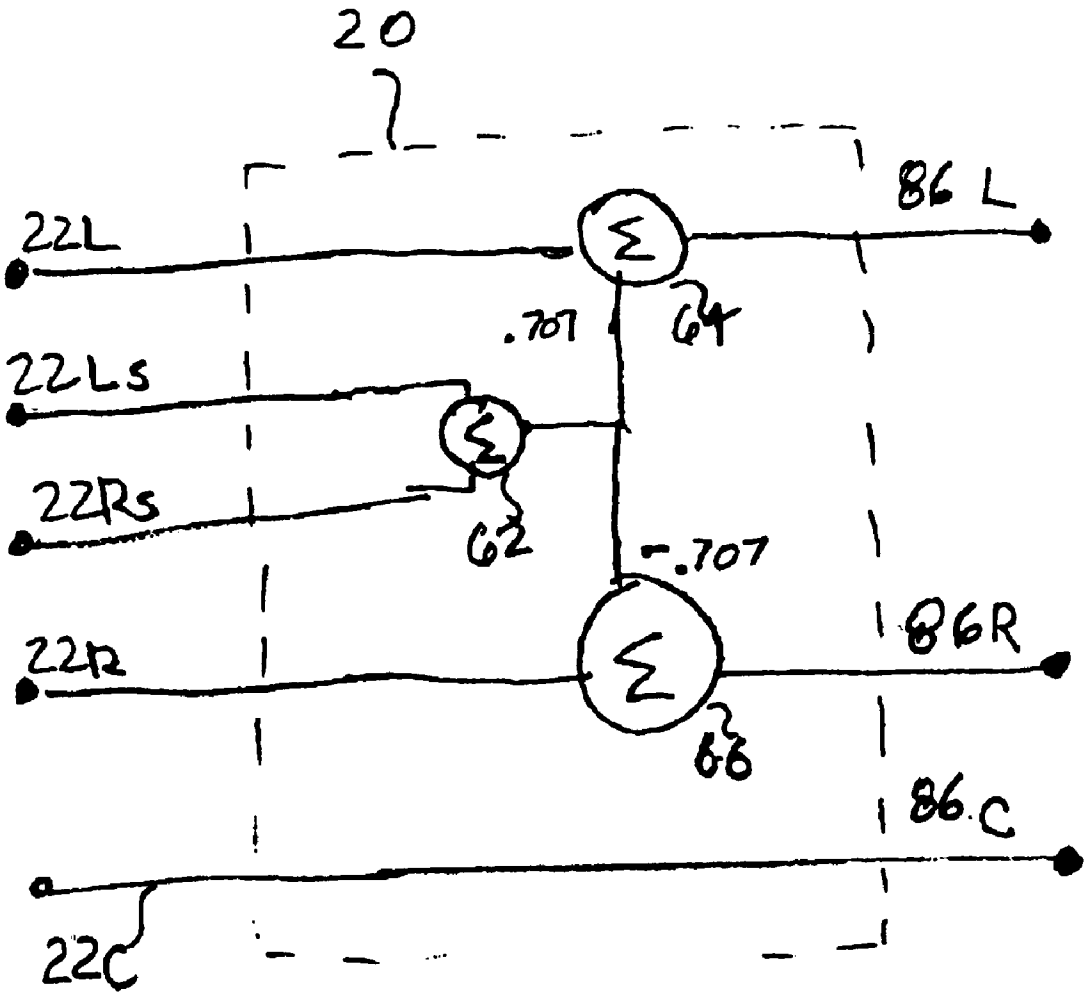
Figure 3D:
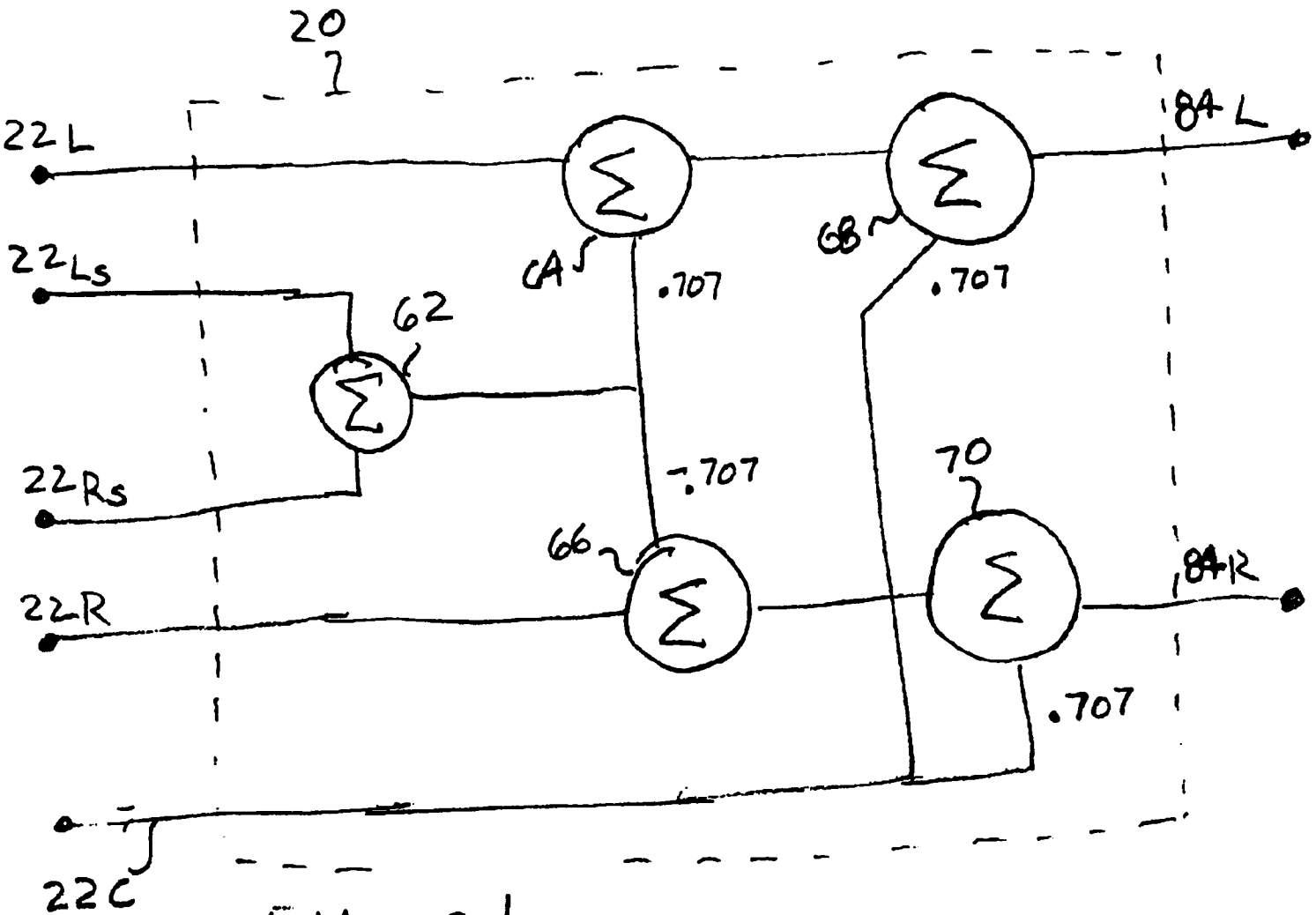
Figure 4:
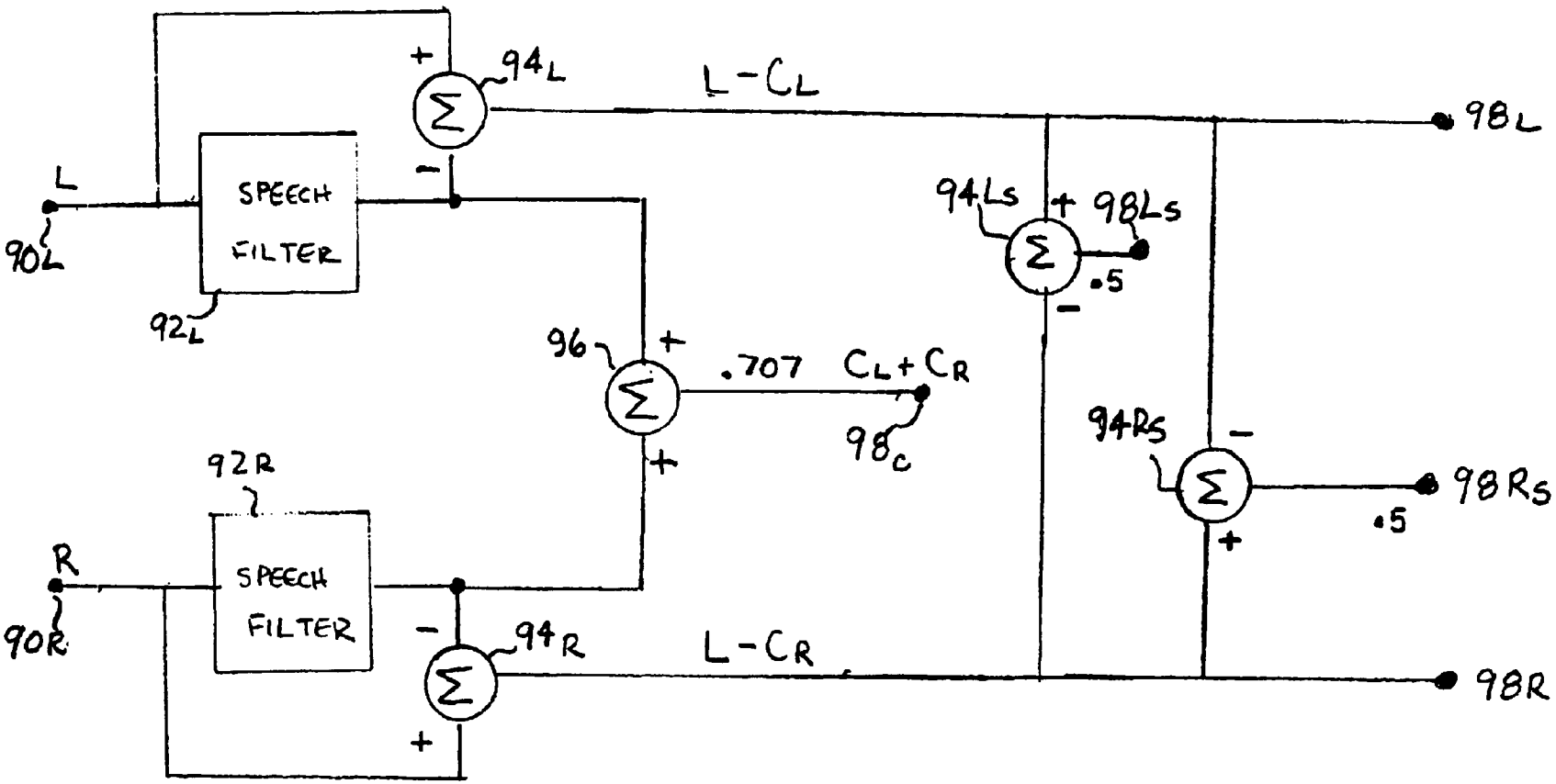

Other features, objects, and advantages will become apparent from the following detailed description, which refers to the following drawings in which:

FIG. 1 is a block diagram of a single channel audio signal processing system according to the invention;

FIGS. 2*a* and 2*b* are circuit diagrams of circuits implementing the speech separator and the multichannel emulator of FIG. 1;

FIGS. 3*a*, 3*b*, 3*c* and 3*d* are block diagrams of alternate embodiments of the postemulation processing system of FIG. 1; and FIG. 4 is a circuit diagram of a circuit implementing the principles of the invention in a two input channel system.

With reference now to the drawings and more particularly to FIG. 1, there is shown a single channel audio signal processing system according to the invention. Single channel signal input terminal 10 is connected to speech separator 12. Speech separator 12 is coupled to multichannel emulator 16 by nonspeech signal line 14 and is coupled to postemulation processing system 20 by speech signal line 18. Multichannel emulator 16 is coupled to postemulation processing system 20 through emulated signal lines $\mathbf{22}_a$–$\mathbf{22}_z$. Speech separator 12 has two output taps, speech level tap 26 and nonspeech level tap 28.

In operation, a single channel signal, such as a monophonic audio signal is input at input terminal 10. The single channel input signal is separated into a speech signal and a nonspeech signal by speech separator 12. The speech signal is output on line 18 as a first output channel signal to postemulation processing system 20. The nonspeech signal portion on line 14 is then processed by multichannel emulator 16 to produce multiple output audio channel signals, which are then processed by postemulation processing system 20. The elements and function of postemulation processing system 20 will be shown in more detail in FIGS. 3*a*–3*d* and explained in more detail in the corresponding portion of the disclosure.

Speech separator 12 may include a bandpass filter in which the pass band is a frequency range, such as 300 Hz to 3 kHz, or such as the so-called "A Weighted" filter described in publication ANSI S1.4-1983, published by the American Institute for Physics for the Acoustical Society of America, which contains the range of frequencies or spectral components commonly associated with speech. Other filters having different characteristics may be used to account for different languages, intonations, and the like. Speech separator 12 may also include more complex filtering networks or some other sort of speech recognition device, such as a microprocessor adapted for recognizing signal patterns representative of speech.

An audio signal processing system according to FIG. 1 is advantageous because transmissions or sources (such as videocassettes) having monophonic audio tracks can be presented on five channel audio systems with realistic "surround" effect, including on-screen localization of dialog.

Referring now to FIG. 2*a,* there is shown one embodiment of a circuit implementing speech separator 12 and multichannel emulator 16. The circuit has a single input channel and five output channels. The input channel may be a monophonic audio signal input, and the five output channels may be a left channel, a right channel, a left surround channel, a right surround channel and a center channel, as in a home theater system.

Speech separator 12 may include input terminal 10, which is coupled to the input terminal of speech filter 80, to a + input terminal of first signal summer 82 and to a + input terminal of second signal summer 84. The output terminal of speech filter 80 is coupled to first multiplier 55 and to speech level tap 26 and is coupled to the − input terminal of first signal summer 82. The output of first multiplier 55 is coupled to center channel signal line 22C and to the − input terminal of second signal summer 84. The output terminal of second signal summer 84 is coupled to multichannel emulator 16 through nonspeech content signal line 14. The output terminal of first signal summer 82 is coupled to nonspeech level tap 28.

Nonspeech content signal line 14 is coupled through delay unit 32 to a + input terminal of third signal summer 34, and a − terminal of fourth signal summer 36, thereby providing multiple paths for processing the nonspeech signal. The output terminal of delay unit 32 is coupled to a − input terminal of fourth signal summer 36, to a + input terminal of seventh signal summer 46 and a + input terminal of eighth signal summer 48. The output terminal of third signal summer 34 is coupled to an input terminal of fifth signal summer 38 and to an input terminal of second multiplier 40. The output terminal of fourth signal summer 36 coupled to a + input terminal of sixth signal summer 42 and to an input terminal of third multiplier 44. The output terminal of fifth signal summer 38 is coupled to left channel signal line 22L and to a − input terminal of seventh signal summer 46. The output terminal of sixth signal summer 42 is coupled to right channel signal line 22R and to a + input terminal of eighth signal summer 48. The output terminal of seventh signal summer 46 is coupled to right surround channel signal line 22$R_S$. The output terminal of eighth signal summer 48 is coupled to left surround signal line 22$L_S$. The output terminal of delay unit 32 is coupled to an input terminal of seventh signal summer 46 and to an input terminal of eighth signal summer 48.

Delay unit 32 may apply a 5 ms delay to the signal. Third signal summer 34 may scale input from delay unit 32 by a factor of 0.5. Fourth signal summer 36 may scale input from delay unit 32 by a factor of 0.5. Seventh signal summer 46 and eighth signal summer 48 may scale their outputs by a factor of 0.5. First multiplier 55 may multiply the input signal from speech filter 80 by a factor of $$\frac{|C|}{|C|+|\overline{C}|}$$

(hereinafter α) where |C| is the time averaged magnitude of the speech signal on line 18 and $|\overline{C}|$ is the time averaged magnitude of the complement of the speech signal. |C| and $|\overline{C}|$ may be measured at speech tap 26 and nonspeech tap 28, respectively. Time averaging of |C| and $|\overline{C}|$ may be done over a sample period, such as 300 ms. Time averaging of the value of |C| may also be done over two different time periods, such as 300 mS and 30 mS, combined, and scaled. Multipliers 40, 44, may multiply their inputs by a factor of α.

For a monophonic input signal M, the circuit of FIG. 2*a* yields the following output signals at the following signal lines:

TABLE 1

| Signal Line | Channel | Signal | Value as $\alpha \rightarrow 0$ | Value as $\alpha \rightarrow 1$ |
|---|---|---|---|---|
| 22C | Center | $\alpha C$ | 0 | C |
| 22L | Left (L) | $\overline{C} + .5\overline{C}\Delta t - \alpha(\overline{C} - .5\overline{C}\Delta t)$ | $\overline{C} + .5\overline{C}\Delta t$ | $\overline{C}\Delta t$ |
| 22R | Right (R) | $\overline{C} - .5\overline{C}\Delta t - \alpha(\overline{C} + .5\overline{C}\Delta t)$ | $\overline{C} - .5\overline{C}\Delta t$ | $-\overline{C}\Delta t$ |
| $22L_S$ | Left Surround | $.5(\overline{C}\Delta t + R)$ | $.5(\overline{C} + 1.5\overline{C}\Delta t)$ | 0 |
| $22R_S$ | Right Surround | $.5(\overline{C}\Delta t - L)$ | $.5(-\overline{C} + 1.5\overline{C}\Delta t)$ | 0 |

where C represents the speech content of signal M, $\overline{C}$ represents the nonspeech content of signal M, $\overline{C}\Delta t$ represents the nonspeech content of signal M delayed in time, L represents the left channel signal, R represents the right channel signal, and α is as defined above.

Referring now to FIG. 2*b,* there is shown a second embodiment of a circuit implementing speech separator 12 and multichannel emulator 16. The circuit includes single input channel and five output channels. The input channel may be a monophonic audio input, and the five output channels may be a left channel, a right channel, a left surround channel, a right surround channel and a center channel, as in a home theater system.

The circuit of FIG. 2*b* is substantially identical to the circuit of FIG. 2*a,* except that in FIG. 2*b,* the input of multiplier 55 is directly coupled to input terminal 10 rather than to the output of speech filter 80, and the signal on center channel signal line 22C is scaled by a factor of 1.414.

A circuit according to the invention is advantageous because it can provide realistic five channel effect from monophonic signals. In the left and right channels, the $\overline{C}$ components are in phase, but the $0.5\overline{C}\Delta t$ components are out of phase, which results in a stereo effect. In the left surround and right surround channels, the $\overline{C}$ component are out of phase, which prevents localization on the left surround and right surround channels. The speech content of signal M is radiated by the center channel only, and is scaled to provide the appropriate power level so that speech is localized on the screen and is of the appropriate level.

A circuit according to the invention is also advantageous because total signal power is maintained. As can be seen in the circuit if FIGS. 2*a* and 2*b,* and table 1, the variable gain a is directly applied to the signal in channel 22C and the signal $\alpha(\overline{C}+0.5\overline{C}\Delta t)$ is subtractively combined with the signal in channels 22L and 22R so that increase in variable gain a results in an increase in signal strength of the signal in channel 22C and a decrease in signal strength in the signals in channels 22L and 22R.

A circuit according to the invention is also advantageous of because the relative proportion of the sound radiated by speakers connected to the various channels is appropriate relative to the speech content of the monophonic input signal. If input signal M contains no speech, then C approaches zero, $\overline{C}$ approaches M, and $\alpha$ approaches zero. In this situation, there is no signal on the center channel and the signals on the other channels are as shown in Table 1. If signal M is predominantly speech, then C approaches M, $\overline{C}$ approaches zero, and $\alpha$ approaches one. In this case, the signal in the left and right surround channels approaches zero, and the signal on the left and right channels approaches $\overline{C}\Delta t$ and $-\overline{C}\Delta t$, respectively. Since the signal is delayed, the center channel is the source of first arrival information, and information from the complementary channels arrives later in time, so that a listener will localize on the radiation from the center channel. When the signal is predominantly speech, the signals on the left surround and right surround channels approach zero, so that there is no radiation from the surround speakers.

A further advantage of the circuit according to the invention is that the combining effect of the circuit is time-varying so that the perceived sources of the left and right channels are not spatially fixed.

Referring to FIGS. 3*a*–3*d,* there are shown alternate embodiments of postemulation processing system 20. In FIG. 3*a,* signal lines 22L, 22$L_S$, 22R, 22$R_S$ and 22C may be coupled to respective electroacoustical transducers 52L, 52$L_S$, 52R, 52$R_S$, and 52C which radiate sound waves corresponding to the signals on signal lines 22L, 22$L_S$, 22R, 22$R_S$ and 22C, respectively. Electroacoustical transducers 52L, 52$L_S$, 52R, 52$R_S$, and 52C may be the left, left surround, right, right surround, and center channel speakers of a home theater system.

In the embodiment of FIG. 3*b,* postemulation processing system 20 may include a crossover network 54, which couples signal lines 22L, 22$L_S$, 22R and 22$R_S$ to tweeters respective tweeters 56L, 56$L_S$, 56R, and 56$R_S$ and to subwoofer 58 and signal line 22C may be coupled to electroacoustical transducer 60. Tweeters 56L, 56$L_S$, 56R, and 56$R_S$ may be the left, left surround, right, and right surround speakers, subwoofer 58 may be the subwoofer, and electroacoustical transducer 60 may be the center channel of a subwoofer/satellite type home theater system.

In the embodiment of FIG. 3*c,* postemulation processing system 20 may include a circuit for downmixing the outputs of multichannel emulator 16 into three channel signals suitable for recording, transmission or for playback on a three-channel system. Input terminals of ninth signal summer 62 are coupled to signal lines 22$L_S$ and 22$R_S$. The output terminal of ninth signal summer 62 is coupled to an input terminal of tenth signal summer 64 and an input terminal of eleventh signal summer 66. Signal from ninth signal summer 62 to tenth signal summer 64 may be scaled by a factor of 0.707, and signal from ninth signal summer 62 to eleventh signal summer 66 may be scaled by a factor of −0.707. An input terminal of tenth signal summer 64 may be coupled to signal line 22L so that the output signal of tenth signal summer 64 is $0.707(L_S+R_S)+L$, (where $L_S$, $R_S$, and L represent the inputs from signal lines 22$L_S$, 22$R_S$, and 22L respectively) which is output at left channel output terminal 86L. Input of eleventh signal summer 66 may be coupled to signal line 22R so that the output of eleventh signal summer 66 is $-0.707(L_S+R_S)+R$, (where $L_S$, $R_S$, and R represent the inputs from signal line 22$L_S$, 22$R_S$, and 22R respectively) which is output at right channel output terminal 86R. Signal line 22C is coupled to center channel output terminal 86C.

In the embodiment of FIG. 3*d,* postemulation processing system 20 includes a circuit for downmixing the output signals of multichannel emulator 16 into two channel signals suitable for recording, transmission, or for playback on a two-channel system. Input terminals of signal summer 62 are coupled to signal lines 22$L_S$ and 22$R_S$. The output terminal of ninth signal summer 62 is coupled to an input terminal of tenth signal summer 64 and an input terminal of eleventh signal summer 66. Signal from ninth signal summer 62 to tenth signal summer 64 may be scaled by a factor of 0.707, and signal from ninth signal summer 62 to eleventh signal summer 66 may be scaled by a factor of −0.707. An input terminal of tenth signal summer 64 is coupled to signal line 22L so that the output signal of tenth signal summer 64 is $0.707(L_S+R_S)+L$, (where $L_S$, $R_S$, and L represent the signals on signal lines 22$L_S$, 22$R_S$, and 22L respectively). The output terminal of tenth signal summer 64 is coupled to an input terminal of twelfth signal summer 68. An input terminal of eleventh signal summer 66 may be coupled to signal line 22R so that the output signal of eleventh signal summer 66 is $-0.707(L_S+R_S)+R$, (where $L_S$, $R_S$, and R represent the inputs from signal lines 22$L_S$, 22$R_S$, and 22R respectively). The output terminal of eleventh signal summer 66 is coupled to an input terminal of thirteenth signal summer 70. Signal from first multiplier 55 to tenth signal summer 68 may be scaled by a factor of 0.707, so that output signal of tenth signal summer 68 is $0.707C+707(L_S+R_S)+L$, (where $L_S$, $R_S$, L, and C represent the inputs from signal lines 22$L_S$, 22$R_S$, and 22L and from first multiplier 55 respectively). The output terminal of tenth signal summer is coupled to left channel terminal output 84L. Signal from first multiplier 55 to thirteenth signal summer 70 may be scaled by a factor of 0.707, so that output of thirteenth signal summer 70 is $0.707C-707(L_S+R_S)+L$, (where $L_S$, $R_S$, L, and C represent the inputs from signal lines 22$L_S$, 22$R_S$, 22L, and 22C, respectively). The output terminal of thirteenth signal summer 70 is coupled to right channel output terminal 84R.

The embodiments of FIGS. 3*c* and 3*d* are advantageous because they can be rerecorded or retransmitted in two- or three-channel format and subsequently decoded for presentation in five-channel format.

Referring now to FIG. 4, there is shown a circuit implementing the principles of the invention in a two input channel system. Left input channel terminal 90L is coupled to an input of left speech filter 92L and additively coupled with left summer 94L. The output of speech filter 92L is differentially coupled with an input of left summer 94L and additively coupled with center summer 96C. The output of left summer 94L is coupled with left channel output terminal 98L and left surround summer 94$L_S$ and differentially coupled with right surround summer 94$R_S$. Right input channel terminal 90R is coupled to an input of right speech filter 92L and additively coupled with right summer 94R. The output of speech filter 92R is differentially coupled with an input of right summer 94R and additively coupled with center summer 96C. The output of right summer 94R is coupled with right channel output terminal 98R and right surround summer 94$R_S$ and differentially coupled with left surround summer 94$L_S$. The output of left surround summer 94$L_S$ is coupled to left surround output terminal 98$L_S$ and output of right surround summer 94$R_S$ is coupled to right surround output terminal 98$R_S$.

In operation a two-channel input signal, such as a stereophonic signal having left and right channels is input at input terminals 90L and 90R, respectively. The circuit separates the speech band portion of the signal, combines the left speech band portion $C_L$ and the right speech band portion $C_R$, combines them, and scales them to form a center channel signal which is output at center channel terminal 98C. The nonspeech portion of the left channel signal and the nonspeech portion of the right channel signal are output at left channel output terminal 98L and right channel output terminal 98R, respectively. The output of center channel terminal 98C may then be used as the center channel of a three- or five-channel audio system. The output of left channel output terminal 98L and right channel output terminal 98R can then be used as the left and right channels of a three channel system. If a five channel output is desired, the output of summer 94R may be differentially combined with the output of summer 94L and scaled to form the left surround channel signal which is output at left surround output terminal 98$L_S$, and the output of summer 94L may be differentially combined with the output of summer 94R and scaled to form the right surround channel signal which can be output at the right surround output terminal 98$R_S$.

Other embodiments are within the claims.

What is claimed is:

1. A method for processing a single channel audio signal to provide a plurality of audio-channel signals, comprising:

separating said single channel audio signal into a first separated signal characterized by a spectral pattern generally characteristic of speech, and a second separated signal;

processing said first separated signal to provide a first audio-channel signal; and modifying said second separated signal to produce the remainder of said plurality of audio-channel signals, wherein said modifying includes:

dividing said second separated signal into a plurality of signals; and multiplying one of the latter signals by a predetermined factor, and wherein said factor is variable with respect to time.

2. A method for processing a single channel audio signal to provide a plurality of audio-channel signals, comprising:

separating said single channel audio signal into a first separated signal characterized by a spectral pattern generally characteristic of speech, and a second separated signal;

processing said first separated signal to provide a first audio-channel signal; and modifying said second separated signal to produce the remainder of said plurality of audio-channel signals, wherein said modifying includes:

dividing said second separated signal into a plurality of signals; and multiplying one of the latter signals by a predetermined factor, and wherein said factor applies a gain that is proportional to the time averaged magnitude of said first separated signal divided by the sum of the time averaged magnitude of said first separated signal and the time averaged magnitude of said second separated signal.

3. A method for processing a single channel audio signal to provide a plurality of audio-channel signals, comprising:

separating said single channel audio signal into a first separated signal characterized by a spectral pattern generally characteristic of speech, and a second separated signal;

processing said first separated signal to provide a first audio-channel signal; and modifying said second separated signal to produce the remainder of said plurality of audio-channel signals, wherein said modifying includes dividing said second separated signal into a plurality of signals; and time-delaying said second separated signal.

4. A method for processing a single channel audio signal to provide a plurality of audio-channel signals, comprising:

separating said single channel audio signal into a first separated signal characterized by a spectral pattern generally characteristic of speech, and a second separated signal;

processing said first separated signal to provide a first audio-channel signal; and modifying said second separated signal to produce the remainder of said plurality of audio-channel signals, wherein said modifying step provides a left channel signal and a right channel signal, and wherein said modifying step further provides a left surround channel signal and a right surround channel signal.

5. An audio signal processing apparatus for processing a single-channel audio signal to provide a plurality of audio channel signals, comprising a separator, for separating said audio signal into a first separated signal characterized by a frequency spectrum characteristic of speech, and a second separated signal; and a first circuit coupled to said separator responsive to said second separated signal for providing a first subset of said plurality of audio channel signals, coupled to said separator, wherein said first circuit comprises multiple signal paths for said second separated signal, one of said multiple signal paths furnishing a time delay.

6. An audio signal processing apparatus for processing a single-channel audio signal to provide a plurality of audio channel signals, comprising a separator, for separating said audio signal into a first separated signal characterized by a frequency spectrum characteristic of speech, and a second separated signal;

and a first circuit coupled to said separator responsive to said second separated signal for, providing a first subset of said plurality of audio channel signals, coupled to said separator, wherein said first circuit comprises multiple signal paths, at least one of said multiple signal paths comprising a multiplier, and wherein said multiple signal paths are constructed and arranged to subtractively combine a signal to which variable gain has been applied with a signal path to which variable gain has not been applied.

7. An audio signal processing apparatus for processing a single-channel audio signal to provide a plurality of audio channel signals, comprising a separator, for separating said audio signal into a first separated signal characterized by a frequency spectrum characteristic of speech, and a second separated signal;

and a first circuit coupled to said separator responsive to said second separated signal for providing a first subset of said plurality of audio channel signals, coupled to said separator, wherein said first subset of said plurality of audio channel signals comprises a left channel signal and a right channel signal, and wherein said first subset of said plurality of audio channel signals comprises a left surround channel signal and a right surround channel signal.

8. An audio signal processing system comprising:

an input terminal for a single input channel signal;

a center channel output terminal for a center channel output signal C;

a plurality of other output terminals, for a corresponding plurality of other output audio channel signals;

a separator for separating said single channel input signal into a speech audio signal and a nonspeech audio signal;

a first circuit coupling said speech audio signal to said center channel terminal, and a second circuit, coupling said separator and said plurality of output terminals responsive to said nonspeech signal, providing a corresponding plurality of other audio channel signals.

9. An audio signal processing system in accordance with claim 8, wherein said second circuit comprises multiple signal paths, one of said multiple signal paths furnishing a time delay.

10. An audio signal processing system in accordance with claim 8, wherein said second circuit comprises multiple signal paths, at least one of said multiple signal paths comprising a multiplier.

11. An audio signal processing system in accordance with claim 10, wherein said multiplier is coupled to an other output terminal that is a left channel output terminal.

12. An audio signal processing system in accordance with claim 10, wherein said multiplier is coupled to an other output terminal that is a right channel output terminal.

13. An audio signal processing system in accordance with claim 8, wherein said separator comprises a band pass filter having a pass band corresponding substantially to the spectrum of speech signals.

14. An audio signal processing system in accordance with claim 8, further comprising a multiplier coupling said separator to said center channel output terminal and multiplying the output of said separator by a predetermined factor.

15. An audio signal processing system in accordance with claim 14, wherein said predetermined factor is variable with respect to time.

16. An audio signal processing system in accordance with claim 14 wherein said predetermined factor is proportional to the time averaged magnitude of said speech audio signal.

17. An audio signal processing system in accordance with claim 16 wherein said predetermined factor is proportional to the time averaged magnitude of said speech audio signal divided by the sum of the time averaged magnitude of the speech audio signal and the time averaged magnitude of said nonspeech audio signal.

18. An audio signal processing system in accordance with claim 8, wherein said second circuit provides a left channel signal L, a right channel signal R, a left surround channel signal $L_S$, and a right surround channel signal RS, further comprising a downmixing circuit coupled to said plurality of other output terminals and to said center channel output terminal, for downmixing said plurality of other output audio channel signals and said center channel signal to provide a plurality of decodable audio channel signals.

19. An audio signal processing apparatus in accordance with claim 18, wherein said plurality of decodable audio channel signals consists of two decodable audio channel signals.

20. An audio signal processing apparatus in accordance with claim 18, wherein said plurality of decodable audio channel signals consists of three decodable audio channel signals.

21. A method for processing a single channel audio signal to provide three decodable audio channel signals subsequently decodable into five audio channel signals, comprising:

separating said single channel audio signal into a first separated signal characterized by a spectral pattern generally characteristic of speech, and a second separated signal;

processing said first separated signal to form a center channel signal comprising a first decodable audio signal;

processing said second separated signal to provide a left channel signal, a right channel signal, a left surround channel signal, and a right surround channel signal;

combining a sum of said left surround and said right surround channel signals with said left channel signal to produce a second of said decodable audio channel signals;

and combining said sum of said left surround with said right surround channel signals, and said right channel signal to produce a third of said decodable audio channel signals.

22. A method for processing a single channel audio signal in accordance with claim 21, further comprising scaling by a predetermined surround factor.

23. A method for processing a single channel audio signal in accordance with claim 22 further comprising reversing the phase of one of said sum comprising one of said second and third decodable audio signals relative to the other of and said second and third decodable audio signals.

* * * * *